US005635324A

United States Patent [19]

Rasmussen et al.

[11] Patent Number: 5,635,324

[45] Date of Patent: Jun. 3, 1997

[54] MULTILAYERED PHOTORECEPTOR USING A ROUGHENED SUBSTRATE AND METHOD FOR FABRICATING SAME

[75] Inventors: Yonn K. Rasmussen; Geoffrey M. T. Foley, both of Fairport; Richard L. Post, Penfield; Robert C. U. Yu, Webster; Satchidanand Mishra, Webster; John F. Yanus, Webster, all of N.Y.

[73] Assignee: Xerox Corporation, Stamford, Conn.

[21] Appl. No.: 407,469

[22] Filed: Mar. 20, 1995

[51] Int. Cl.[6] ..... G03G 5/047; G03G 5/14

[52] U.S. Cl. ..... 430/58; 430/60; 430/64; 430/127; 430/131; 430/59

[58] Field of Search ..... 430/60, 62, 64, 430/127, 131, 58

[56] References Cited

U.S. PATENT DOCUMENTS

| | | | |
|---|---|---|---|
| 4,076,564 | 2/1978 | Fisher | 156/664 |
| 4,134,763 | 1/1979 | Fujimura et al. | 427/299 |
| 4,390,611 | 6/1983 | Ishikawa et al. | 430/59 |
| 4,551,404 | 11/1985 | Hiro et al. | 430/59 |
| 4,588,667 | 5/1986 | Jones et al. | 430/73 |
| 4,596,754 | 6/1986 | Tsutsui et al. | 430/58 |
| 4,618,552 | 10/1986 | Tanaka et al. | 430/60 |
| 4,741,918 | 5/1988 | Nagy de Nagybaczon et al. | 427/180 X |
| 4,797,337 | 1/1989 | Law et al. | 430/58 |
| 4,904,557 | 2/1990 | Kubo | 430/56 |
| 4,965,155 | 10/1990 | Nishiguchi et al. | 430/58 |
| 5,004,662 | 4/1991 | Mutoh et al. | 430/59 |
| 5,051,328 | 9/1991 | Andrews et al. | 430/56 |
| 5,069,758 | 12/1991 | Herbert et al. | 205/73 |
| 5,089,908 | 2/1992 | Jodoin et al. | 359/212 |
| 5,096,792 | 3/1992 | Simpson et al. | 430/58 |
| 5,188,916 | 2/1993 | Hodumi et al. | 430/65 |
| 5,252,422 | 10/1993 | Okano et al. | 430/131 |
| 5,286,591 | 2/1994 | Hongo | 430/60 |
| 5,399,452 | 3/1995 | Takegawa et al. | 430/56 X |
| 5,464,717 | 11/1995 | Sakaguchi et al. | 430/58 |

*Primary Examiner*—Roland Martin
*Attorney, Agent, or Firm*—Oliff & Berridge

[57] ABSTRACT

A photoreceptor and method eliminate interference-fringe print defect due to interference effects caused by reflected beams from various interfaces in a multilayered photoreceptor. The substrate surface is formed with specific dimensions so as to enable the coating of the substrate with an undercoat film including, for example, an organometallic compound or an organometallic chelate compound such as any suitable hydrolyzable organozirconium, organotitanium or organoaluminum compound with a silane. Elimination of the "pepper spot" print defect is accomplished without the addition of a thickening agent to the undercoat film.

37 Claims, 3 Drawing Sheets

MULTILAYERED PHOTORECEPTOR USING A ROUGHENED SUBSTRATE AND METHOD FOR FABRICATING SAME

BACKGROUND OF THE INVENTION

1. Field of the Invention

This invention relates to photoreceptors suitable for application to xerographic printers and like machines that use coherent light sources and methods for fabricating photoreceptors. More particularly, this invention relates to a multilayered photoreceptor having a conductive substrate having a designated surface roughness that eliminates an interference-fringe print defect in the resulting printer output and enables the use of undercoat layer materials, such as an organometallic or organometallic chelate compound with a silane, examples of which include any suitable hydrolyzable organozirconium, organotitanium or organoaluminum compound with a silane. The invention also relates to a fabrication method for forming a substrate, for example a metallic substrate, of a multilayered photoreceptor to produce a specific surface morphology and surface roughness, and coating the roughened substrate with the undercoat film without a thickening agent.

2. Description of Related Art

Xerographic printers and like machines that use multilayered photoreceptors in conjunction with a coherent light source suffer from an interference effect that manifests as a printable defect that can be described as a series of dark and light interference fringes that resemble wood grains. The use of coherent illumination sources in conjunction with multilayered photoreceptors produces the interference effect through the interaction between various reflected components of the incident light whose difference in optical path length varies from one area of the photoreceptor to another. Such spatial variation in the optical path length arises because the coated layers have inherent spatial thickness variations imposed by limitations in the coating process. The spatial variation in the optical path length in turn produces absorption variation in the charge generating layer of the photoreceptor, resulting in the interference-fringe defect in prints generated by these xerographic machines.

FIG. 1 is a schematic view of a typical photoreceptor of a multilayered design. In FIG. 1, the photoreceptor 10 includes a substrate 1, an undercoat layer 2, a charge generating layer 3, and a charge transport layer 4.

In the present device, which comprises three organic layers 2–4 coated on a metallic substrate 1, an incident light beam 5 is directed at the charge transport layer 4. The primary light beam 5 is then reflected from the planes that define interfaces 7, 9A, 9B and 9C between the layers 1–4 of the multilayered photoreceptor. More specifically, reflected light beam 6 is generated via reflection from the interface 7 between the atmospheric air and the charge transport layer 4, reflected light beam 8A is generated via reflection from the interface 9A between the charge transport layer 4 and the charge generating layer 3, reflected light beam 8B is generated via reflection from the interface 9B between the charge generating layer 3 and the undercoat layer 2, and reflected light beam 8C is generated via reflection from the interface 9C between the undercoat layer 2 and the substrate 1. The primary reflections that contribute to the interference-fringe print defect producing interference effect are the reflected beam 6 generated at the interface 7 between the surrounding atmospheric air and the charge transport layer 4 and the reflected beam 8C from the interface 9C between the undercoat layer 2 and the substrate 1, where the differences in optical indices are the greatest.

Many methods have been proposed to suppress the charge transport layer/air interface specular reflection, including roughening of the charge transport layer surface by introducing $SiO_2$ and other particles into the charge transport layer, applying an appropriate overcoating layer and the like.

Many methods have also been proposed to suppress the intensity of substrate surface specular reflection, e.g., coating specific materials such as anti-reflection materials and light scattering materials on the substrate surface and roughening methods such as anodization, dry blasting and liquid honing of the substrate surface. However, such methods must achieve their primary objective of eliminating substrate surface reflections without adversely impacting the electrical parameters or print quality of photoreceptors into which they are incorporated.

Patents on interference-fringe effect suppression in general and suppression of the substrate surface reflection in particular include Tanaka et al. U.S. Pat. No. 4,618,552 (adding an opaque conductive layer above the ground plane), Nagy de Nagybaczon et al. U.S. Pat. No. 4,741,918 (coating process using a buffing wheel), Kubo et al. U.S. Pat. No. 4,904,557 (roughened photosensitive layer on top of a smooth substrate surface), Fujimura et al. U.S. Pat. No. 4,134,763 (grinding method to roughen the substrate surface), Simpson et al. U.S. Pat. No. 5,096,792 (addition of antireflection layer on top of the substrate surface), and Andrews et al. U.S. Pat. No. 5,051,328 (Indium Tin Oxide transparent ground plane as the substrate).

A liquid honing process, for example, is an effective technique to create a highly scattered surface on a metallic substrate, and is used in some multilayered devices to eliminate the interference-fringe effect. The method, however, has several disadvantages which the present invention overcomes.

For example, the liquid honing process is an added step following diamond lathing which thereby increases the cost of production of a substrate. The surface morphology of the substrate created by liquid honing method also does not lend itself to be used in conjunction with a thin-film forming undercoat layer material, such as the aforementioned organometallic or organometallic chelate compound with a silane, due to the nature of the surface texture that is undesirable for a thin-layer coating in the thickness range of approximately 0.05–0.5 μm and still provides complete surface coverage of the substrate. It is required that the thin-film forming undercoat layer materials provide continuous coverage of the underlying metallic substrate in order that print defects due to charge injection from the substrate are eliminated.

In typical multilayered photoreceptors, a resins layer is inserted as an undercoat layer between the substrate and the photosensitive layers in order to provide mechanical strength, better adhesion between the substrate and the photosensitive layers and improved cyclic stability. Each intermediate layer may be any layer conventionally employed between the substrate and the photosensitive layer as illustrated for example in Tanaka et al., U.S. Pat. No. 4,618,552 and Andrews et al., U.S. Pat. No. 5,051,328, the disclosures of which are incorporated herein by reference. Accordingly, the intermediate layer may be a subbing layer, barrier layer, adhesive layer, and the like. The intermediate layer may be formed of, for example, casein, polyvinyl alcohol, nitrocellulose, ethyleneacrylic acid copolymer, polyamide (nylon 6, nylon 66, nylon 610, copolymerized nylon, alkoxymethylated nylon, and the like), polyurethane, gelatin, and the like. Intermediate adhesive layers between the substrate and the subsequently applied layers may be desirable to improve adhesion. Typical adhesive layers include film-forming polymers such as polyester, polyvinylbutyral, polyvinylpyrrolidone, polycarbonate, polyurethane, polymethyl methacrylate, and the like as well as mixtures thereof. The intermediate layer may be deposited by any conventional means such as dip coating and vapor deposition and preferably has a thickness of from about 0.05 to about 5 microns.

Typical resin layers, however, exhibit poor environmental cyclic stability due to the fact that the volume resistivity of a resin greatly depends on the ionic conductivity and is strongly affected by temperature and humidity conditions. Many proposals have been made to form an undercoat layer using organic metal compounds or silane coupling agents to improve upon the environmental effects. Okano et al. U.S. Pat. No. 5,252,422 and Hodumi et al. U.S. Pat. No. 5,188,916, for example, discuss the use of organic metal chelate compounds or organic metal alkoxide compounds with silane coupling agents as an improved undercoat layer in a multilayered photoreceptor for visible light xerographic applications. When this type of an undercoat material is used in combination with a roughened substrate for interference fringe suppression for printer applications where a coherent exposure light source is used, an addition of a resin is required to increase the thickness of the undercoat layer to ensure continuous coverage to avoid charge injection from the substrate. Examples of a print defect caused by charge injection from the substrate include a cluster of black spots in a white background in a discharge area development (DAD) system, which are commonly known as "pepper spots."

Thick undercoat layers, however, produce undesirable electrical effects including a high residual voltage build up and poor cyclic stability. An example of a thick undercoat layer including an organometallic or an organometallic chelate compound is a mixture of acetylacetone zirconium tributoxide and γ-aminopropyltrimethoxysilane and solvents and a polyvinyl butyral resin added as a thickening agent. In order to suppress residual build up in a low temperature and low humidity condition in particular, fabrication using this type of a mixture containing a resin requires a humidification step that results in increased unit manufacturing costs and decreased throughput efficiency. Hongo et al. U.S. Pat. No. 5,286,591 also discloses a subbing layer containing an organic chelate compound or an organic alkoxide compound but with a hygroscopic compound having at least two carboxyl groups per molecule to improve upon environmental cyclic stability. A resin binder is also used to increase the thickness of the subbing layer in the case where interference-fringe image defect suppression is required via roughening of a substrate using a liquid honing method.

SUMMARY OF THE INVENTION

An object of the present invention is to overcome the shortfalls from conventional techniques by providing a method of suppressing or eliminating the strong specular reflection from an undercoat/substrate interface to eliminate the printable interference-fringe defect in xerographic printers and like machines that use coherent illumination as the exposure light source.

Another object of the present invention is to provide a method for making a photoreceptor using a forming method, for example, a diamond lathing process, that produces specific surface roughness on the conductive substrate, whereby a thin-film forming undercoat layer material, such as a mixture of any suitable hydrolyzable organozirconium, organotitanium or organoaluminum compound and a silane in appropriate solvents, can be directly applied to a roughened substrate such as a diamond lathed substrate, at a desired coating thickness without any addition of a resin as a viscosity increasing agent. Examples of organometallic and organometallic chelate compounds include organotitanate and organotitanate chelate compounds, organozirconate and organozirconate chelate compounds and organoaluminate and organoaluminate chelate compounds.

Examples of hydrolyzable organo silane may be reperesented by the following formula:

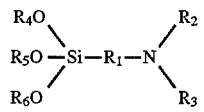

wherein R1 is an alkylidene group containing 1 to 20 carbon atoms, R2 and R3 are independently selected from the group consisting of H, a lower alkyl group containing 1 to 3 carbon atoms, a phenyl group and a poly(ethyleneamino) group, and R4, R5, and R6 are independently selected from a lower alkyl group containing 1 to 4 carbon atoms. The organoaminosilane is hydrolyzed in an aqueous solution with the organometallic compound. Typical hydrolyzable silanes include γ-aminopropyl triethoxy silane, (N,N-dimethyl 3-amino) propyl triethoxysilane, N,N-dimethylaminophenyl silane, N-phenyl aminopropyl trimethoxy silane, triethoxy silylpropylethylene diamine, trimethoxy silylpropylethylene diamine, trimethoxy silylpropyldiethylene triamine, N-aminoethyl-3-aminopropyltrimethoxysilane, N-2-aminoethyl-3-aminopropyltrimethoxysilane, N-2-aminoethyl-3-aminopropyltris(ethylethoxy)silane, p-aminophenyl trimethoxysilane, 3-aminopropyldiethylmethylsilane, N,N'-dimethyl 3-amino) propyltriethoxysilane, 3-aminopropylmethyldiethoxysilane, γ-aminopropyl trimethoxysilane, N-methylaminopropyltriethoxysilane, methyl[2-(3-trimethoxysilylpropylamino)ethylamino]-3-proprionate, (N,N'-dimethyl 3-amino)propyl triethoxysilane, N,N-dimethylaminophenyltriethoxy silane, trimethoxysilylpropyldiethylenetriamine and mixtures thereof.

A further object of the present invention is to provide a multilayered photoreceptor including a diamond lathed substrate that does not require liquid honing after diamond lathing, and to provide a thin-film undercoat layer overlaying the substrate, wherein the undercoat layer has the coated thickness in the range of 0.05 to 0.5 micron. An example of such a thin-film forming undercoat layer material includes an organometallic or organometallic chelate compound with a silane such as a mixture of acetylacetone zirconium tributoxide and γ-aminopropyl-trimethoxysilane without the addition of a polyvinyl butyral resin as a thickening agent.

In accordance with a first aspect of the present invention, there is provided a method of making a photoreceptor having a substrate and an undercoat film. The method includes forming the substrate with a specified core roughness with respect to the dimensions of the peaks and valleys of the substrate, and coating the substrate with the undercoat film. The thickness of the undercoat film may be in the range of 0.05–0.5 micron.

The forming step may be a diamond lathing step, and the undercoat film, such as an organometallic or an organometallic chelate compound with a silane layer, may have a thickness of 0.05–0.5 μm, that provides continuous coverage of the substrate, thereby avoiding "pepper spots."

In accordance with a second aspect of the present invention, there is provided a multilayered photoreceptor having a roughened substrate and an undercoat film comprising a silane and an organometallic or an organometallic chelate compound. The undercoat film is substantially without a thickening agent and does not require a thickening agent or a humidification step for processing. The undercoat film may comprise a mixture of an acetylacetone zirconium tributoxide and γ-aminopropyltrimethoxysilane, i.e., one that does not require a polyvinyl butyral resin as a thickening agent or a humdification processing step.

With this arrangement, it is possible to produce a multilayered organic photoreceptor that does not require liquid honing of the substrate after diamond lathing, adding a thickening agent to the undercoat layer to ensure continuous coverage of the undercoat layer, or using a humidification step in manufacturing.

According to a third aspect of the invention, there is provided a method of eliminating specular reflection from an interface between a substrate and an undercoat film comprising the steps of forming the substrate to have a roughness that enables the substrate to be coated with the undercoat film substantially without a thickening agent, and coating the substrate with the undercoat film.

These and other aspects and advantages of the present invention are described in or apparent from the following detailed description of preferred embodiments.

BRIEF DESCRIPTION OF THE DRAWINGS

The invention will be described in detail with reference to the following drawings, wherein.

DETAILED DESCRIPTION OF PREFERRED EMBODIMENTS

Figure 1:
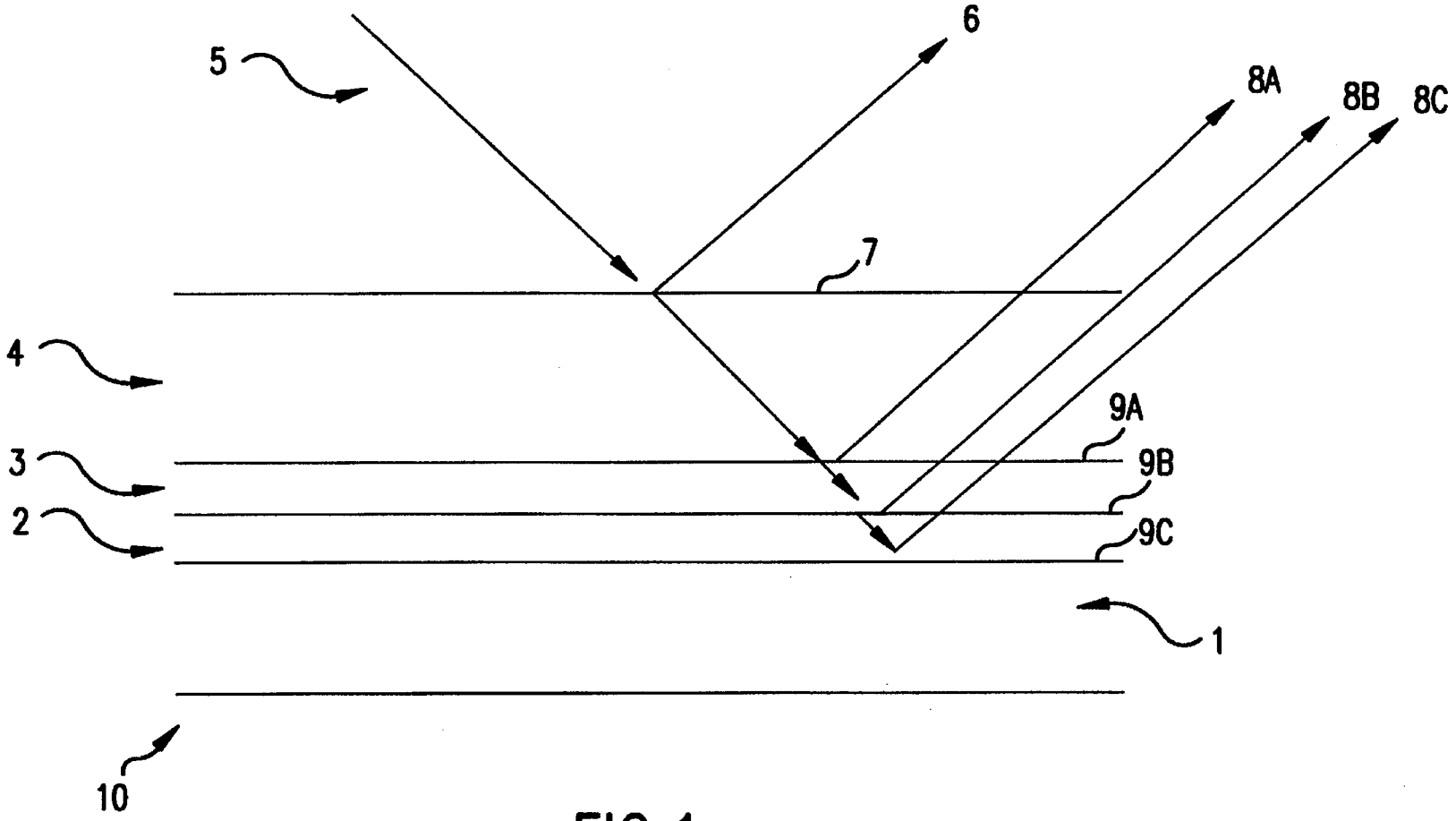
FIG. 1 RELATED ART
FIG. 1 is a schematic cross-sectional view showing the primary reflections that contribute to the interference effect in a multilayered conventional device.

The present invention will now be described in detail by way of preferred embodiments of the manufacturing method referred to in the drawings. The present invention is applicable to any fabrication process involving forming, for example, by diamond lathing, a conductive substrate and coating the substrate with a thin-film forming undercoat layer such as a any suitable hydrolyzable organozirconium, organotitanium or organoaluminum compound with a silane, for example, a mixture of acetylacetone zirconium tributoxide and γ-aminopropyltrimethoxysilane in appropriate solvents. The desired dried coated thickness for the undercoat layer ranges between 0.05–0.5 micron and preferably between 0.08–0.12 micron. The present invention is particularly desirable for use in conjunction with organic multilayered photoreceptors used with a coherent light source to suppress interference fringes. The unit manufacturing costs of these photoreceptors can be reduced because there is no need for a liquid honing step after diamond lathing of the substrate in cases where a liquid honing is currently used, the addition of a thickening agent such as a polyvinyl butyral resin to the undercoat layer, or a humidification step during manufacturing.

Figure 2:
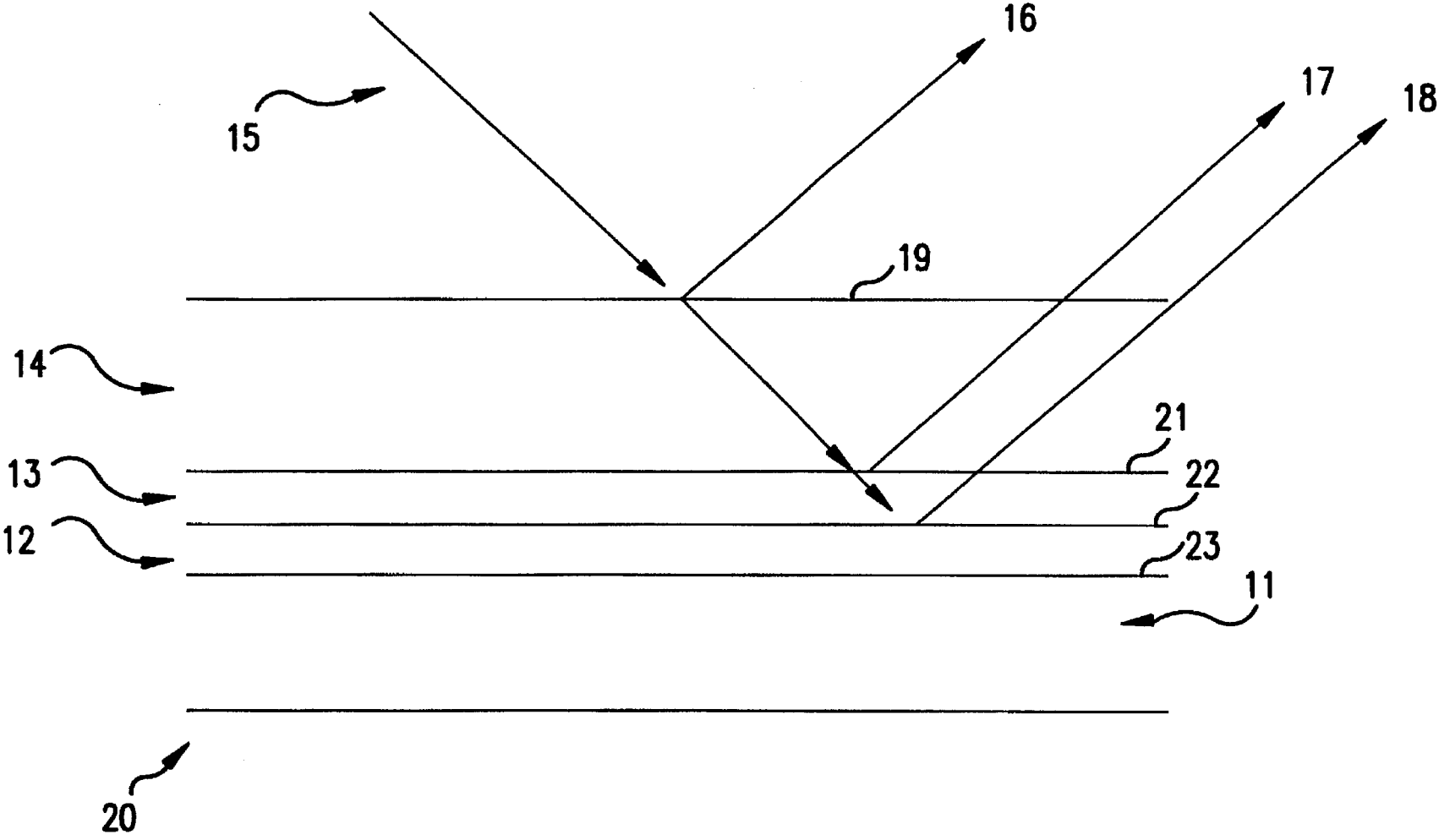
FIG. 2 is a schematic cross-sectional view of the photoreceptor of the present invention.

FIG. 2 is a schematic cross sectional view of the photoreceptor of the present invention. A multilayered photoreceptor 20 includes a substrate 11, an undercoat film or layer 12 overlaying the substrate, a charge generating layer 13 overlaying the undercoat film, and a charge transport layer 14 overlaying the charge generating layer 13.

The conductive substrate is typically aluminum and generally cylindrical, and is cleaned by any suitable technique after the surface morphology of the substrate is formed. Other types of conductive materials including conductive plastic and other metals and metal alloys such as stainless steel, brass and the like can be also employed as a substrate. If diamond lathing is used to create the surface roughness, the lathing lubricants and any foreign substances introduced to the substrate surface during diamond lathing are removed. Although FIG. 2 is intended to portray a cross-sectional view of cylindrical substrate, any substrate geometry such as a hollow or solid cylinder, a flat sheet, a seamed or unseamed belt, or any other form that allows conventional coating techniques such as dip coating, vapor deposition and the like can be used. The substrate may be finished with one or more undercoat layers and/or a photosensitive layer as follows.

One or more of any suitable hydrolyzable organozirconium, organotitanium or organoaluminum compound with a silane as an undercoat film 12 may be employed in embodiments of the present invention. Examples of aforementioned organometallic and organometallic chelate compounds include organotitanate and organotitanate chelate compounds, organozirconate and organozirconate chelate compounds and organaluminate and organoaluminate chelate compounds. Specific examples include acetyl acetonate titanate chelate, ethyl acetoacetate titanate chelate, triethanolamine titanate chelate, lactic acid titanate chelate, neopentyl(diallyl)oxy, tri(N-ethylenediamino) ethyl titanate, neopentyl(diallyl)oxy, tri (m-amino)phenyl titanate, cyclo(dioctyl)pyrophosphato dioctyl titanate, cyclo(dioctyl)pyrophosphato dioctyl zirconate, and diisobutyl (oleyl) aceto acetyl aluminate and diisopropyl (oleyl) aceto acetyl aluminate.

Typical hydrolyzable silanes include γ-aminopropyl triethoxy silane, (N,N-dimethyl 3-amino) propyl triethoxysilane, N,N-dimethylaminophenyl silane, N-phenyl aminopropyl trimethoxy silane, triethoxy, silylpropylethylene diamine, trimethoxy silylpropylethylene diamine, trimethoxy silylpropyldiethylene triamine, N-aminoethyl-3-aminopropyltrimethoxysilane, N-2-aminoethyl-3-aminopropyltrimethoxysilane, N-2-aminoethyl-3-aminopropyltris(ethylethoxy)silane, p-aminophenyl trimethoxysilane, 3-aminopropyldiethylmethylsilane, (N,N'-dimethyl 3-amino)propyltriethoxysilane, 3-aminopropylmethyldiethoxysilane, γ-aminopropyl trimethoxysilane, N-methylaminopropyltriethoxysilane, methyl[2-(3-trimethoxysilylpropylamino)-ethylamino]-3-proprionate, (N,N'-dimethyl 3-amino)propyl triethoxysilane, N,N-dimethylaminophenyltriethoxy silane, trimethoxysilylpropyldiethylenetriamine and mixtures thereof. The preferred silane materials are γ-aminopropyltriethoxysilane, γ-aminopropyltrimethoxysilane, N-aminoethyl-3-aminopropyltrimethoxysilane, (N,N'-dimethyl 3-amino) propyltriethoxysilane, and the like or mixtures thereof because the hydrolyzed solutions of these materials exhibit a greater degree of basicity and stability and because these materials are readily available commercially.

In embodiments, a charge transport layer 14 and a charge generating layer 13 comprise the photosensitive layers. This is referred to as a laminate type photosensitive material. Charge transport and charge generating layers may be deposited by any suitable conventional technique including dip coating and vapor deposition and are well known in the art as illustrated for example in U.S. Pat. No. 4,390,611, U.S. Pat. No. 4,551,404, U.S. Pat. No. 4,588,667, U.S. Pat. No. 4,596,754, and U.S. Pat. No. 4,797,337, the disclosures of which are incorporated herein by reference. In embodiments, the charge generating layer 13 may be formed by dispersing a charge generating material selected from commercially available azo pigments such as Sudan Red, Dian Blue, Janus Green B, and the like; quinone pigments such as Algol Yellow, Pyrene Quinone, Indanthrene Brilliant Violet RRP, and the like; quinocyanine pigments; perylene pigments; indigo pigments such as indigo, thioindigo, and the like; bisbenzoimidazole pigments such as Indofast Orange toner, and the like; phthalocyanine pigments such as copper phthalocyanine, aluminochloro-phthalocyanine, oxytitanium phthalocyanine, chloroindium phthalocyanine and the like; quinacridone pigments; or azulene compounds in a binder resin such as polyester, polystyrene, polyvinyl butyral, polyvinyl pyrrolidone, methyl cellulose, polyacrylates, cellulose esters, and the like. In embodiments, the charge transport layer may be formed by dissolving a positive hole transporting material selected from compounds having in the main chain or the side chain a polycyclic aromatic ring such as anthracene, pyrene, phenanthrene, coronene, and the like, or a nitrogen-containing hetero ring such as indole, carbazole, oxazole, isoxazole, thiazole, imidazole, pyrazole, oxadiazole, pyrazoline, thiadiazole, triazole, and the like, and hydrazone compounds in a resin having a film-forming property. Such resins may include polycarbonate, polymethacrylates, polyarylate, polystyrene, polyester, polysulfone, styrene-acrylonitrile copolymer, styrene-methyl methacrylate copolymer, and the like.

In embodiments, the photosensitive material may be of a single-layer type comprising the charge generating material, charge transporting material, and the binder resin, wherein these three materials may be as described above. Single layer type photosensitive materials may be deposited by an suitable technique including dip coating and vapor deposition and are illustrated, for example, in Mutoh et al., U.S. Pat. No. 5,004,662 and Nishiguchi et al., U.S. Pat. No. 4,965,155, the disclosures of which are incorporated herein by reference.

In operation, an incident light beam 15 is reflected from various layers of the multilayered photoreceptor. In particular, a reflected beam 16 is generated from the interface 19 between the charge transport layer 14 and the atmospheric air surrounding the photoreceptor, a beam 17 is generated from the interface 21 between the charge generating layer 13 and the charge transport layer 14, and a beam 18 is produced by the interface 22 between the charge generating layer 13 and the undercoat layer 12.

As compared with FIG. 1, the photoreceptor of FIG. 2 does not generate a strong specular reflection from the interface 23 between the substrate and the undercoat layer. The interference effect can be minimized or eliminated if the strong specular reflection from the charge transport layer surface or the strong specular reflection from the substrate surface is eliminated or suppressed. By creating a substrate surface with the desired surface characteristics, the intensity of the primary specular reflection is suppressed. The method by which the undercoat layer/substrate specular reflection is minimized or eliminated will now be described.

According to the method for eliminating interference between the substrate and the undercoat layer interface, the substrate 11 is formed to include a surface texture that is optimal for enabling continuous coating of thin-film forming undercoat layer materials such as any of the aforementioned suitable organometallic or organometallic chelate compounds with a silane having a dried coated thickness between approximately 0.05–0.5 μm and preferably between 0.08–0.12 μm. In order for the substrate to accommodate a thin layer of such undercoat materials, the substrate of the photoreceptor is designed to have a specified roughness.

Specifically, the surface texture of the substrate is described by a set of parameters: the core roughness depth $R_k$, found in the Abbott-Firestone curve or the Material Ratio Curve; the mean roughness $R_a$; the average distance of the five highest peaks to the five lowest valleys in a given sampling length, $R_{ZISO}$; the maximum roughness depth, $R_{max}$; the average slope $D_a$ and Peak Count $R_{t1(0.1)}$. Each of these parameters is described in detail below.

Figure 3:
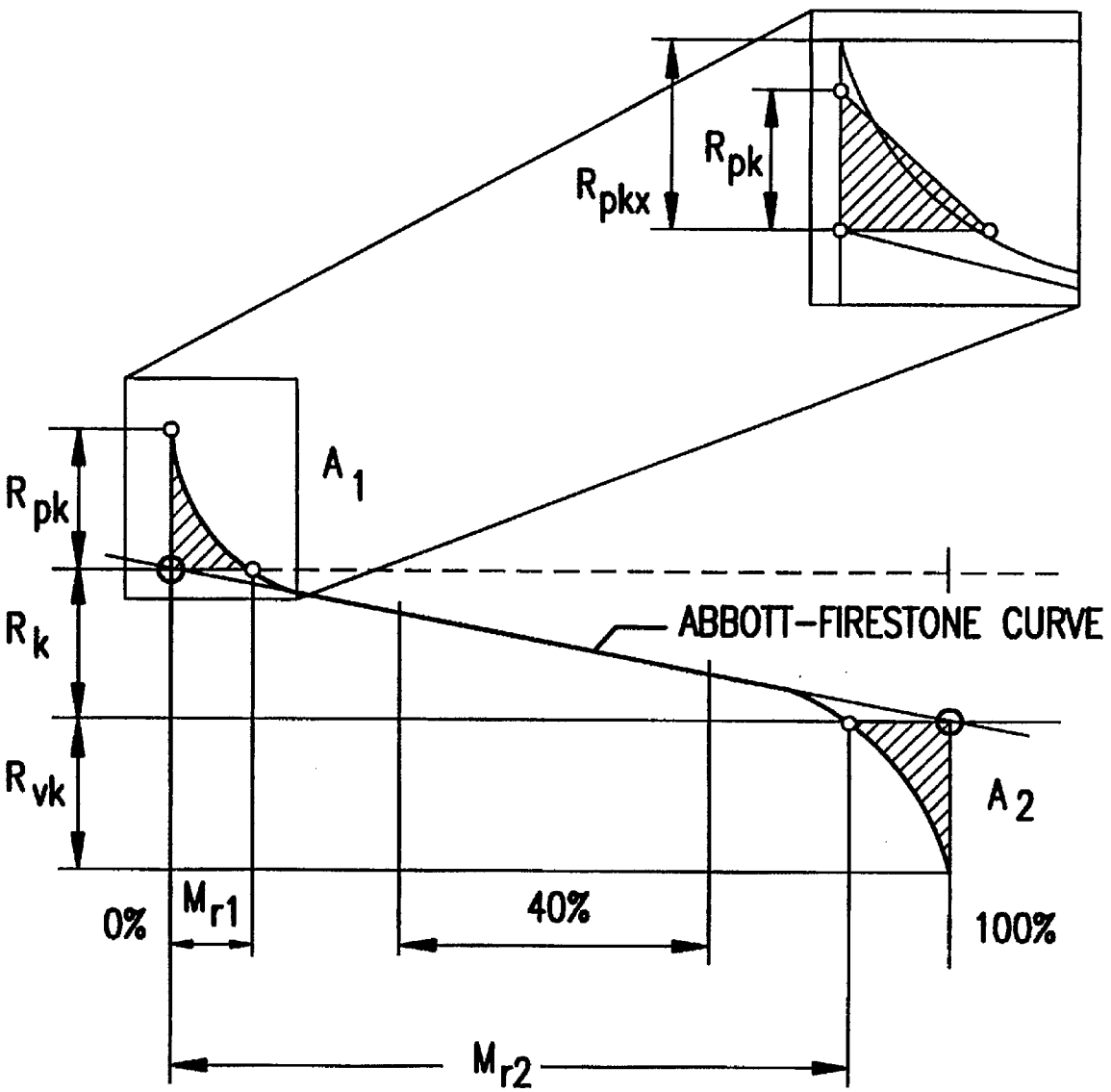
FIG. 3 illustrates the Material Ratio Curve or Abbott-Firestone curve.

FIG. 3 illustrates the Material Ratio Curve, which is the graphical representation of material ratio calculated throughout the depth of the profile. $R_k$ is the depth of the core roughness profile for which the Material Ratio Curve can be closely approximated by a bestfit straight line which is determined by a secant to the Material Ratio Curve representing the smallest rise over a material ratio range of 40%. $R_a$ is the arithmetic average of all departures of the roughness profile from the center line within the evaluation length. $R_a$ is defined by a formula:

$$R_a = \frac{1}{I_m} \int_O^{Im} |y| dx$$

in which $l_m$ represents the evaluation length, |y| represents the absolute value of departures of the roughness profile from the center line.

The expression $R_{max}$ represents the largest single roughness gap within the evaluation length. The evaluation length is that part of the traversing length that is evaluated. An evaluation length containing five consecutive sampling lengths is taken as a standard. $R_{ZISO}$ can also be defined by a formula:

$$R_{ZISO} = \frac{1}{5} \sum_{i=1}^{5} Y_{pi} + \sum_{i=1}^{5} Y_{vi}$$

in which $Y_{pi}$ represents the value of departure of the roughness profile above the center line from the center line, and $Y_{vi}$ represents the value of departure of the roughness profile below the center line from the center line. $D_a$ is the arithmetic average slope of all profile peaks within the evaluation length $l_m$. Peak count Rt(x) is defined as the number of peaks which have risen above the upper reference level and have fallen adjacently below the lower reference level. Peak count is always related to a length of 10 mm. The reference level is determined by the value of x and the upper and lower reference levels are symmetrical to the center line. The reference level is therefore 0.1 micron for $R_{t1}(0.1)$.

These measurements may be made with a profilameter such as Model S8P manufactured by Mahr Feinpruef Corporation. Generally, a stylus with a diamond tip is traversed over the surface of the roughened substrate at a constant speed to obtain all data points within an evaluation length. The radius of curvature of the diamond tip used to obtain all data referred to herein is 5 microns.

For the present embodiment, $R_k$ is in the range of about 0.1–0.7 μm and preferably between 0.2–0.5 μm, $R_{ZISO}$ is in the range of about 0.1–1.2 μm and preferably between 0.5–0.8 μm, $R_a$ is in the range of about 0.05–0.5 μm and preferably between 0.05–0.2 μm, $R_{max}$ is below about 1.5 μm and preferably below 1 μm, $D_a$ is below about 0.08 μm and preferably below 0.06 μm, and $R_{t1(0.1)}$ is greater than about 100 counts and preferably greater than about 200 counts.

With a photoreceptor having a substrate roughened within the above specified ranges for the different roughness parameters mentioned above, it is possible to coat a continuous layer of thin-film forming undercoat layer materials that include any suitable hydrolyzable organozirconium, organotitanium or organoaluminum compound with a silane. An example of such an undercoat materials includes a mixture of acetylacetone zirconium tributoxide and γ-aminopropyltrimethoxysilane and solvents, without adding a polyvinyl butyral resin as a thickening agent to increase its viscosity from approximately 3–5 centipoise to above 10 centipoise and without humidification treatment after coating. This enables a thin-film coating in the range 0.05–0.5 micron, provides continuous coverage of the undercoat layer on the substrate and eliminates or suppresses interference fringes to an acceptable level and does not require separate liquid honing of the substrate after diamond lathing if diamond lathing is used for roughening the substrate surface.

The use of acetylacetone zirconium tributoxide and γ-aminopropyltrimethoxysilane and solvents in combination with a roughened substrate without a thickening agent, rather than the same solution formulation with a thickening agent such as a polyvinyl butyral resin as a viscosity increasing agent, provides two advantages. First, it provides commonality for the undercoat layer solution between other multilayered photoreceptors designed for printer applications with a coherent exposure light source and like machines using roughened substrates for interference-fringe defect suppression and photoreceptors designed for light lens xerographic applications that are typically coated on substrates with smooth "mirror" like surfaces where $R_{max}$ is much less than 0.4 micron and that do not require an addition of a resin as a thickening agent in the undercoat layer. This results in a more efficient operation for equipment changeovers, solution preparation, etc. in the manufacturing environment. Second, the thin undercoat layer in the thickness range 0.05–0.5 micron comprising any suitable hydrolyzable organozirconium, organotitanium or organoaluminum compound with a silane such as a mixture of acetylacetone zirconium tributoxide and γ-aminopropyltrimethoxysilane, without the addition of a resin component, produces less residual voltage build up and better cyclic stability than a thicker undercoat layer comprising the same materials as above but with a resin component that is added to increase the layer thickness to provide complete undercoat layer coverage of the substrate in the event where the surface morphology of the substrate requires a thickening agent for complete coverage. Currently the liquid honed surface of the substrate is not optimal for enabling the use of thin undercoat film materials such as the hydrolyzable organozirconium, organotitanium or organoaluminum compound with a silane without the addition of a viscosity increasing agent, which also requires a subsequent humidification processing step.

COMPARATIVE EXAMPLES

The material package described in the following paragraphs was used to dip coat a three-layer photoreceptor which has high photosensitivity in the infrared wavelength region particularly between 700–800 nm. The printers in which the photoreceptor was tested had an exposure light source at approximately 780 nm wavelength. The material package described below was coated on substrates that were specially diamond lathed according to the present invention (Example 6), diamond lathed to a "mirror" like surface (Examples 1 and 2), or diamond lathed to a "mirror" like surface and subsequently liquid honed using a conventional dip coating method (Examples 3–5).

The substrate employed in all of Examples 1–4 and 6 was 6063 alloy aluminum which was formed to have either the roughened surface morphology described in the present invention or surface characteristics with roughness values outside of the ranges of the present invention. The thickness of the substrate was approximately 1 mm. For the "mirror" like surface (Examples 1 and 2), which is formed to be as smooth as possible, $R_a$ was less than 0.05 μm, $R_{t1(0.1)}$ was less than 50 counts, $R_{ZISO}$ was less than 0.3 μm, $R_k$ was less than 0.15 μm, $D_a$ was less than 0.04 μm and $R_{max}$ was below 0.4 μm. In the case in which liquid honing was applied after diamond lathing, a conventional wet honing method with glass beads was used. After the honing step, the substrate surface roughness values for Examples 3 and 4 were as follows: $R_a$ between 0.4–1.0 μm, $R_{ZISO}$ between 3.4–6.0 μm, $R_k$ between 1.3–3.8 μm, $R_{max}$ between 5 and 8 μm and $D_a$ between 0.15 and 0.18 μm. After the honing, a cleaning step removed any residual honing beads prior to dip coating an undercoat layer, a charge generating layer and a charge transport layer. As part of the class of devices with honed substrate surface morphology belonging to Example 4, other examples of honed substrate surface roughness were also examined for pepper spot evaluation. For example, a three-layer photoreceptor comprising a honed surface with $R_a$ between 0.15–0.2 μm, $R_{ZISO}$ between 1.2–1.5 μm, $R_k$ between 0.4–0.6 μm, $R_{max}$ between 1.8–2.2 μm and $D_a$ between 0.1 and 0.15 μm was evaluated for pepper spots. Substrate surface roughness values for Example 5 also belong to this latter category. The undercoat film used in Examples 1, 4 and 6 included 13 wt % acetylacetone zirconium tributoxide, Orgatics ZC540 available from Matsumoto Kosho Co. Ltd., and 1.4 wt % γ-aminopropyltrimethoxysilane, A1110 available from Nihon Unica Co. Ltd., in 56.4 wt % isopropyl alcohol 28.2 wt % butanol and 1 wt % deionized water mixture. Example 5 is a typical three-layer photoreceptor that contains the same materials as examples 1, 4 and 6 in the undercoat layer but with an addition of a polyvinyl butyral resin, S-Lec BM-1.SP available from Sekisui Chemical Co., Ltd. as a thickening agent; this three-component undercoat material requires a humidification processing step. Examples 2 and 3 had an undercoat film that included a 9 wt % type-8 nylon resin, e.g., Luckamide 5003, available from Dainippon Ink & Chemicals, Ltd. in a 50 wt % methanol, 33 wt % butanol and 8 wt % deionized water mixture.

As an example, the charge generating layer for Examples 1–4 and 6 included a mixture of 1 wt % oxytitanium phthalocyanine (TiOPC) IV and 5 wt % chloroindium phthalocyanine (ClInPc) in a 4 wt % polyvinyl butyral resin binder, BUTVAR B-79 available from Monsanto Chemical company, and 90 wt % n-butyl acetate as a solvent. Example 5 device is a typical three-layer photoreceptor with metal-free phthalocyanine in a polyvinyl butyral resin binder as a charge generating layer.

The charge transport layer for Examples 1–4 and 6 included a mixture of 7 wt % tri-p-tolylamine, TTA available from Eastman Kodak company, and 4 wt % N,N'-diphenyl-N,N'-bis (3-methylphenyl)-1, 1'-biphenyl-4, 4'-diamine in a 14 wt % polycarbonate resin binder, IUPILON Z-200 available from Mitsubishi Gas Chemical Company, Inc., and 75 wt % monochlorobenzene as a solvent. Example 5 device contains N,N'-diphenyl-N,N'-bis (3-methylpheny)-1,1'-biphenyl-4,4'-diamine in a polycarbonate resin binder as a charge transport layer.

The approximate dried coated layer thickness ranges for the undercoat film were 0.1–0.2 μm for acetylacetone zirconium tributoxide and γ-aminopropyltrimethoxysilane (Example 6), and 1–2 μm for type-8 nylon (Examples 2 and 3). The typical dried coated thickness for the undercoat layer of the device of Example 5 is 0.5–2 μm for acetylacetone zirconium tributoxide and γ-aminopropyltrimethoxysilane and a polyvinyl butyral resin. Dip coating velocities were determined to achieve appropriate target coating thicknesses. Typically, faster dip coating velocity results in thicker layer thicknesses for a given viscosity of a solution. For example, the coating velocity for the acetylacetone zirconium tributoxide and γ-aminopropyltrimethoxysilane at a target thickness of 0.1 μm was 175 mm/minute, and the coated layer was dried at 150 degrees C. for 7.5 minutes. The coating velocity for the type-8 nylon was approximately 200 mm/minute for the target thickness of 1.5 μm, and the coated layer was dried at 145 degrees C. for 10 minutes. The thickness for the dried charge generating layer film was 0.2–0.3 μm and, for the dried charge transport layer film, the thickness was 16–18 μm. The coating velocity for the charge generating layer was approximately 200 mm / minute for the target layer thickness of approximately 0.2–0.3 μm, and the coated layer was dried at 106 degrees C. for 10 minutes. The coating velocity for the charge transport layer was, for example, approximately 85 mm/minute for 16.5 μm target layer thickness, and the coated layer was dried at 118 degrees C. for 45 minutes.

Table 1 summarizes the results of initial print tests of "pepper spot" and interference-fringe defect levels. Pepper spot levels were evaluated on prints using a scale from 0 to 5. A pepper spot level of "0" is required to meet the acceptable level of print quality established for most printers and like machine applications.

Interference-fringe defect level was evaluated on prints using a scale from 0 to 3 and above. "0" interference-fringe level is required to meet the acceptable level of print quality established for most printer applications and like machines. For both "pepper spot" and interference-fringe defect analysis, Standard Image References (S.I.R.) were used for evaluation. Testing conditions for print testing for pepper spot evaluations in a stringent 'A' zone environmental condition were 80% relative humidity (RH) and 80 degrees F. temperature. Stress tests were also performed under a 'C' zone condition, of which the conditions were 20% RH/60 degrees F., to assess long-term cyclic stability.

As can be seen from Table 1, Examples 1 and 2 display unacceptable levels of the interference-fringe defect. While Examples 3 and 4 show 0 level of the interference-fringe defect, unacceptable "pepper spot" levels were observed. Finally, while Example 5 has acceptable interference-fringe defect and "pepper spot" performance, the undercoat layer (acetylacetone zirconium tributoxide and γ-aminopropyltrimethoxysilane) requires the addition of a thickening agent (polyvinylbutyral resin) and a humidification processing step. Example 6 (the present invention) displayed excellent interference-fringe and "pepper spot" performance without the use of a thickening agent or a humidification processing step.

TABLE 1

| Example | Substrate/Undercoat layer | Pepper Spot S.I.R.** level | Interference-fringe defect S.I.R. level |
|---|---|---|---|
| Example 1 | Mirror lathed/acetylacetone zirconium tributoxide and γ-aminopropyltrimethoxysilane | 0 | >3 |
| Example 2 | Mirror lathed/Type-8 nylon resin | 1.5 | >3 |
| Example 3 | Honed/ Type-8 nylon resin | 2.0 | 0 |
| Example 4 | Honed/acetylacetone zirconium tributoxide and γ-aminopropyltrimethoxysilane | 1.0–4.0 | 0 |
| Example 5* | Honed/acetylacetone zirconium tributoxide and γ-aminopropyltrimethoxysilane with a polyvinyl butyral resin | 0 | 0 |
| Example 6 | Special lathed/acetylacetone zirconium tributoxide and γ-aminopropyltrimethoxysilane | 0 | 0 |

*Requires a processing step in a humidification chamber.
**Standard Image Reference (S.I.R.)

Table 2 shows long-term cyclic stability of the present invention photoreceptor. Even after 10,000 prints, no apparent print degradation was observed in either the 'A' or 'C' zones. $V_{high}$ and $V_{low}$, corresponding to the initial surface potential and the surface potential at approximately 7 ergs exposure energy, respectively, varied little after 10,000 prints in both zones. In particular, there were no pepper spots or interference-fringe print defects observed in either the 'A' or 'C' zones during the print testing up to 10,000 prints. The testing device was a Compaq Pagemarq 20 laser printer with 20 pages per minute printing speed, 11 micron toner size and a 780 nm laser diode as the exposure light source.

TABLE 2

| Device | Number of prints/ Test Zone | $V_{high}$ (0 ergs) | $V_{low}$ (approximately 7 ergs) | Pepper Spot S.I.R. level |
|---|---|---|---|---|
| Example 6 | initial print/A | 340 | 50 | 0 |
| Example 6 | initial print/C | 350 | 55 | 0 |
| Example 6 | 10,000/C | 335 | 50 | 0 |
| Example 6 | 10,000/A | 320 | 40 | 0 |

Table 3 shows that the voltage characteristics of the present invention has acceptable performance levels in other respects. Advantages were observed with regard to electrical characteristics in addition to "pepper spot" and interference-fringe defect improvement. Acetylacetone zirconium tributoxide and γ-aminopropyltrimethoxysilane devices showed lower dark decay, which is a measure of the surface potential drop in the photoreceptor without any exposure to light, and lower charge depletion per unit area, which is a measure of the same phenomenon specifically underneath the scorotron in terms of excess surface charge needed over the capacitive charge for a certain desired voltage, compared to type 8 nylon resin devices when measured in a specialized electrical scanner. The scanner simulates xerographic machine charging and exposure without toner development and paper transfer processes. The photoreceptor was exposed at 0.28 seconds after scorotron charging to −380 V and voltages were measured at 0.42 seconds after scorotron charging. Table 3 shows the electrical measurement results and emphasizes the superiority of the present invention (Example 6) over, for example, the device described in Example 3, with respect to dark decay and charge depletion per unit area, Q/A.

TABLE 3

| Device | Substrate Under coat layer | $V_{high}$ (0 ergs) | $V_{low}$ (7 ergs) | $V_{dark}$ decay (0.26sec) | Q/A depletion (nC/cm$^2$) |
|---|---|---|---|---|---|
| Example 3 | Honed/ type-8 nylon resin | 358 | 79 | 21 | 8.4 |
| Example 6 | Special lathed/ acety-lacetone zir-conium tributox-ide and γ-amino-propyltri methoxy-silane | 372 | 67 | 15 | 3.0 |

The invention has been described in detail with reference to preferred embodiments thereof, which are intended to be illustrative, not limiting. Various changes may be made and may be apparent to those of ordinary skill in the art without departing from the spirit and scope of the invention as defined in the following claims.

What is claimed is:

1. A method of making a photoreceptor having a multilayered structure including a substrate and an undercoat film covering said substrate, said method comprising the steps of:

forming peaks and valleys in the substrate to have a core roughness depth ($R_k$) of about 0.1–0.7 μm, an arithmetic mean of the five highest of said peaks and the five deepest of said valleys ($R_{ZISO}$) of about 0.1–1.2 μm, an arithmetic average slope of all profile peaks ($D_a$) of below about 0.08 μm and an arithmetic mean value ($R_a$) of the amplitudes of all peaks and valleys ranging between about 0.05–0.5 μm;

forming no fewer than about 200 of said peaks and valleys over a 10 mm length with a peak to valley distance of at least about 0.2 μm;

coating the substrate with said undercoat film;

forming a charge generating layer over said undercoat film; and forming a charge transport layer over said charge generating layer, wherein said multilayered photoreceptor is suitable for use in xerographic printers capable of producing print output substantially free of pepper spots, and interference-fringe defect that would otherwise be produced due to specular reflection along an interface between the substrate and the undercoat film.

2. The method according to claim 1, wherein said forming step includes forming said peaks and valleys to have a maximum roughness value (Rmax) of no greater than about 1.5 μm.

3. The method according to claim 1, wherein said forming step includes forming said peaks and valleys to have a maximum roughness value (Rmax) of no greater than about 1.0 μm.

4. The method according to claim 1, wherein said core roughness depth ($R_k$) is about 0.2–0.5 μm, said arithmetic mean of the five highest and five lowest of said peaks and valleys ($R_{ZISO}$) is about 0.5–0.8 μm, the arithmetic average slope ($D_a$) is less than about 0.06 μm, and the arithmetic mean value ($R_a$) is about 0.05–0.02 μm.

5. The method according to claim 1, wherein said forming step and said coating step further comprise eliminating specular reflections of an incident light beam from an interface between said undercoat film and said substrate.

6. The method according to claim 1, wherein said forming step includes diamond lathing the substrate.

7. The method according to claim 1, wherein said coating step includes coating said undercoat film on said substrate with a thickness of approximately 0.05–0.5 μm.

8. The method according to claim 7, wherein said undercoat film has a thickness between 0.08–0.12 μm.

9. The method according to claim 1, wherein said undercoat film comprises one of an organometallic compound and an organometallic chelate compound with a silane.

10. The method according to claim 9, wherein said undercoat film comprises an undercoat film substantially without a thickening agent.

11. The method according to claim 10, wherein said undercoat film comprises acetylacetone zirconium tributoxide and γ-aminopropyltrimethoxysilane.

12. The method according to claim 10, wherein said undercoat film comprises a silane and one of an organozirconate compound, an organozirconate chelate compound, an organotitanate compound, an organotitanate chelate compound, an organoaluminate compound and an organoaluminate chelate compound.

13. The method according to claim 10, wherein said silane comprises a hydrolyzable organo silane represented by the following formula:

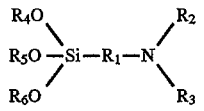

wherein R1 is an alkylidene group containing 1 to 20 carbon atoms, R2 and R3 are independently selected from the group consisting of H, a lower alkyl group containing 1 to 3 carbon atoms, a phenyl group and a poly(ethyleneamino) group, and R4, R5, and R6 are independently selected from a lower alkyl group containing 1 to 4 carbon atoms.

14. The method according to claim 9, wherein said undercoat film comprises a silane and one of an organozirconate compound, an organozirconate chelate compound, an organotitanate compound, an organotitanate chelate compound, an organoaluminate compound and an organoaluminate chelate compound.

15. The method according to claim 9, wherein said silane comprises a hydrolyzable organo silane represented by the following formula:

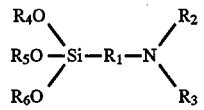

wherein R1 is an alkylidene group containing 1 to 20 carbon atoms, R2 and R3 are independently selected from the group consisting of H, a lower alkyl group containing 1 to 3 carbon atoms, a phenyl group and a poly(ethyleneamino) group, and R4, R5, and R6 are independently selected from a lower alkyl group containing 1 to 4 carbon atoms.

16. The method according to claim 1, wherein said undercoat film comprises an undercoat film substantially without a thickening agent.

17. A multilayered photoreceptor comprising:

a roughened substrate having no fewer than about 200 peaks and valleys over a 10 mm length with a peak to valley distance of at least about 0.2 μm;

an undercoat film formed on said substrate, said undercoat film comprising a mixture of a silane and one of an organometallic compound and an organometallic chelate compound, said undercoat film being substantially without a thickening agent;

a charge generating layer formed over the undercoat film; and a charge transport layer overlaying said charge generating layer, wherein said multilayered photoreceptor is suitable for use in xerographic printers capable of producing print output substantially free of pepper spots and interference-fringe defect that would otherwise be produced due to specular reflection along an interface between the substrate and the undercoat film.

18. The photoreceptor according to claim 17, wherein said undercoat film comprises a silane and one selected from the group consisting of an organozirconate compound, an organozirconate chelate compound, an organotitanate compound, an organotitanate chelate compound, an organoaluminate compound and an organoaluminate chelate compound.

19. The photoreceptor according to claim 17, wherein said undercoat film comprises acetylacetone zirconium tributoxide and aminopropyltrimethoxysilane.

20. The photoreceptor according to claim 17, wherein said silane comprises a hydrolyzable organo silane represented by the following formula:

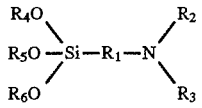

where R1 is an alkylidene group containing 1 to 20 carbon atoms, R2 and R3 are independently selected from the group consisting of H, a lower alkyl group containing 1 to 3 carbon atoms, a phenyl group and a poly(ethyleneamino) group, and R4, R5, and R6 are independently selected from a lower alkyl group containing 1 to 4 carbon atoms.

21. The photoreceptor according to claim 17, wherein said peaks and valleys have a core roughness depth ($R_k$) of about 0.1–0.7 μm, an arithmetic mean of the five highest of said peaks and the five deepest of said valleys ($R_{ZISO}$) of about 0.1–1.2 μm, an arithmetic average slope ($D_a$) is less than about 0.08 μm, and an arithmetic mean value of the amplitudes of all said peaks and said valleys ($R_a$) between about 0.05–0.5 μm.

22. The photoreceptor according to claim 21, wherein said peaks and valleys have a maximum roughness value (Rmax) of no greater than about 1.5 μm.

23. The photoreceptor according to claim 21, wherein said peaks and valleys have a maximum roughness value (Rmax) of no greater than about 1.0 μm.

24. The photoreceptor according to claim 21, wherein said core roughness depth ($R_k$) is about 0.2–0.5 μm, said arithmetic mean of the five highest and five lowest of said peaks and valleys ($R_{ZISO}$) is about 0.5–0.8 μm, the arithmetic average slope ($D_a$) is less than about 0.06 μm, and the arithmetic mean $R_a$ is about 0.05–0.2 μm.

25. The photoreceptor of claim 17, wherein said charge generating layer comprises oxytitanium phthalocyanine IV and chloroindium phthalocyanine in a polyvinyl butyral resin binder, and said charge transport layer comprises tri-p-tolylamine and N,N'-diphenyl-N,N'-bis-1,1'-biphenyl-4,4'-diamine in a polycarbonate resin binder.

26. The photoreceptor according to claim 17, further comprising a single-layer photosensitive layer comprising said charge generating layer and said charge transporting layer.

27. The photoreceptor according to claim 17, wherein said undercoat film has a thickness of about 0.05–0.5 μm.

28. The photoreceptor according to claim 27, wherein said undercoat layer thickness is about 0.08–0.12 μm.

29. A method of eliminating pepper spots from print output and specular reflection from an interface between a substrate and an undercoat film of a photoreceptor, said method comprising the steps of:

forming said substrate to have a roughness enabling said substrate to be coated with said undercoat film substantially without a thickening agent, said substrate having no fewer than about 200 peaks and valleys over a 10 mm length with a peak to valley distance of at least about 0.2 μm;

coating said substrate with said undercoat film; and forming charge generating and transport layers overlaying the undercoat film, wherein said multilayered photoreceptor is suitable for use in xerographic printers capable of producing print output substantially free of interference-fringe defect and pepper spots.

30. The method according to claim 29, wherein said forming step further comprises:

diamond lathing the peaks and valleys;

dimensioning the peaks and valleys so that a core roughness depth ($R_k$) is about 0.1–0.7 μm, an arithmetic mean value of the five highest of said peaks and the five lowest of said valleys ($R_{ZISO}$) is between about 0.1–1.2 μm, an arithmetic average shape ($D_a$) of all the profile peaks is less than about 0.08 μm, and an arithmetic mean value of the amplitudes of all of the peaks and valleys ($R_a$) is about 0.05–0.5 μm.

31. The method according to claim 30, wherein said peaks and valleys to have a maximum roughness value (Rmax) of no greater than about 1.5 μm.

32. The method according to claim 30, wherein said peaks and valleys to have a maximum roughness value (Rmax) of no greater than about 1.0 μm.

33. The method according to claim 30, wherein said core roughness depth ($R_k$) is about 0.2–0.5 μm, said arithmetic mean of the five highest and five lowest of said peaks and valleys ($R_{ZISO}$) is about 0.5–0.8 μm, the arithmetic average slope ($D_a$) is less than about 0.06 μm, and the arithmetic mean value ($R_a$) is about 0.05–0.2 μm.

34. The method according to claim 29, wherein said undercoat film comprises one of an organometallic compound and an organometallic chelate compound with a silane, and said coating step comprises coating said substrate with one of said organometallic compound and said organometallic chelate compound with a silane.

35. The method according to claim 34, wherein said coating step comprises coating said substrate with said undercoat film having a thickness of about 0.05–0.5 μm.

36. The method according to claim 35, wherein said undercoat film thickness is about 0.08–0.12 μm.

37. The method according to claim 29, wherein said coating step comprises coating said undercoat film on a non-liquid honed substrate.

* * * * *